United States Patent [19]

McCall

[11] Patent Number: 4,807,372

[45] Date of Patent: Feb. 28, 1989

[54] CLEATED SHOE WALKING SOLE

[76] Inventor: Hannon L. McCall, #10 Hilltop Trailer Park, Bristol, Tenn. 37620

[21] Appl. No.: 144,262

[22] Filed: Jan. 13, 1988

[51] Int. Cl.[4] ..... A43B 5/18

[52] U.S. Cl. ..... 36/135; 36/75

[58] Field of Search ..... 36/7.5, 131, 132, 135, 36/100, 101, 72 A

[56] References Cited

U.S. PATENT DOCUMENTS

| | | | |
|---|---|---|---|
| 1,406,657 | 2/1922 | Knizek | 36/7.5 |
| 3,283,424 | 11/1966 | Struntz | 36/7.5 |
| 3,775,875 | 12/1973 | Dvorsky | 36/72 A |
| 4,055,005 | 10/1977 | Meinhart | 35/135 |
| 4,267,650 | 5/1981 | Bauer | 36/101 |
| 4,301,604 | 11/1981 | Hamilton | 36/135 |
| 4,351,120 | 9/1982 | Dalebout | 36/117 |
| 4,364,137 | 12/1982 | Melendez | 36/15 |
| 4,542,599 | 9/1985 | Annovi | 36/117 |
| 4,620,375 | 11/1986 | Wallace | 36/7.5 |

FOREIGN PATENT DOCUMENTS

| | | | |
|---|---|---|---|
| 2520988 | 12/1983 | France . | |
| 205507 | 6/1939 | Switzerland | 36/7.5 |
| 12812 | of 1905 | United Kingdom | 36/7.5 |

*Primary Examiner*—Steven N. Meyers

*Attorney, Agent, or Firm*—Luedeka, Hodges & Neely

[57] ABSTRACT

A walking sole for use with a bicyclist's shoe having a cleat for engaging corresponding structure on the bicycle pedal includes a sole member for attachment to the shoe including front and rear portions connected together with a hinge. The front portion of the sole member is provided with a recess and, in a walking position, receives the cleat to provide a smooth walking surface. For riding, the front portion folds rearwardly at the hinge to a position beneath the rear portion where it is clear of the cleat.

11 Claims, 1 Drawing Sheet

12
36
32
34
22
24
20
10
13
14
16
12
28
14
13

30
10
22
18
26
24
32
20
12
36
34
32
20
14
22
24
18
10

CLEATED SHOE WALKING SOLE

FIELD OF THE INVENTION

The present invention relates to shoes worn by bicyclists and more particularly relates to a walking sole for attachment to a cleated bicyclist's shoe.

BACKGROUND OF THE INVENTION

Bicycle enthusiasts often wear specially constructed shoes which have cleats attached to their bottom sufaces for attachment to corresponding structure on the bicycle pedals. The use of cleats alone or in combination with other structures on the pedal prevent undesired slippage of the shoe on the pedal and permits the bicyclist to thrust the pedal forward with great force along the top of the stroke and backward with greater force along the bottom of the stroke. In addition, the cleat and related structure enable the bicyclist to employ the lifting action of the legs and thus pull the pedal upwardly along the back half of the stroke as the opposite pedal is pushed downwardly.

Unfortunately, however, the cleats which are typically positioned under the ball of the foot and are made out of slippery hard plastic make the shoe sole uneven and walking in the shoe is very difficult. Furthermore, the cleat can be damaged if a great deal of walking is done such as when the bicyclist has a flat tire. The cleats can also deface floors and other surfaces.

While shoe soles have been developed for covering the cleat and providing a walking surfaces, it is necessary for such shoe soles to be entirely removed before the shoe can be used for riding. Thus, the removable covers are impractical since they must be carried separately by the bicyclist. This is an obvious disadvantage to cyclists who are interested in the freedom from additional gear and the need to have a backpack or bags on the bicycle to carry such items.

It is accordingly an object of the present invention to provide a walking sole for cleated bicyclists' shoes which provide a smooth walking surface. It is another object of the present invention to provide a walking sole which can be used in a walking configuration to provide a walking surface and in a riding configuration in which the sole remains attached to the shoe but does not interfere with the use of the cleat for attachment to the pedal.

SUMMARY OF THE INVENTION

Accordingly, a walking sole is provided for use with a bicyclist's shoe having a cleat attached to its bottom surface for engaging corresponding structure on the pedal of the bicycle. The walking sole includes a sole member having a front portion and a rear portion and has a periphery which generally corresponds to the outer edge of the shoe. The first portion includes a recess configured to receive the cleat of the shoe. The front portion and rear portion are connected together by a hinge so that the front portion folds under the rear portion to move from a walking position in contact with the shoe sole to a riding position in which the front portion underlies the rear portion and is clear of the cleat. The rear portion of the sole member is attached to the shoe and means are provided to selectively secure the front portion in either the walking or riding position.

In accordance with a preferred form of the invention, hook and loop pile fasteners are used to secure the rear portion to the shoe sole, most preferably with the loop portion being attached to the sole. In accordance with the preferred form of the invention, the front portion is attached in either the walking or riding position by the use of hook and loop pile fasteners. In the most preferred form of the invention, a hook pile strip is secured adjacent the toe of the shoe and a hook pile strip is attached adjacent the heel of the shoe. A doubled-over loop pile strip is attached to the front portion which has sufficient length to attach to the hook pile strip on the toe and secure the front portion in the walking position and to attach to the hook pile strip on the heel to secure the front portion in the riding position.

Further objects and the advantages of the present invention will become more apparent from the following detailed description taken in conjunction with the accompanying drawings in which:

DESCRIPTION OF THE PREFERRED EMBODIMENT

Figures 1, 2, 3:
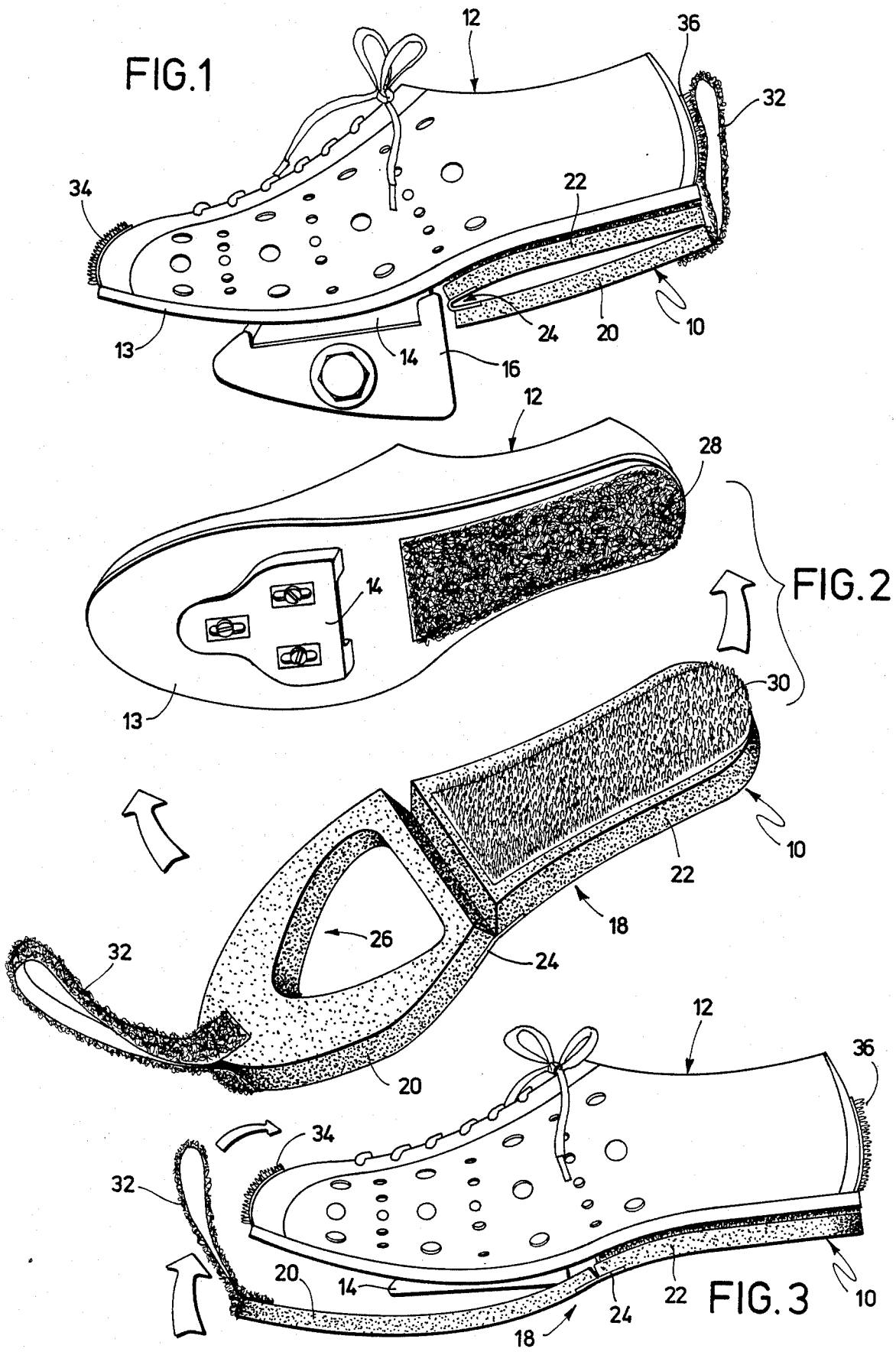
FIG. 1 is an elevational view of a bicyclist's shoe having a cleat engaged by a binding on the pedal which includes a preferred form of the walking sole in accordance with the present invention shown in the riding configuration
FIG. 2 is a perspective view of the bottom of the shoe and the walking sole in accordance with the present invention illustrating attachment to the shoe.
FIG. 3 is an elevational view showing how the sole is converted from the riding position to the walking position.

Referring now to the above-described drawings in which like reference characters designate like or corresponding parts throughout the several views, walking sole 10 in accordance with the present invention is illustrated in FIGS. 1–3. The walking sole 10 is intended for use with a bicyclist's, shoe 12 which includes a cleat 14 on the shoe sole 13 for attaching to a pedal 16 having structure for engaging the cleat 14. The cleat 14 and pedal 16 illustrated are of the "ski-binding" type such as the cleat and pedal sold under the trademark LOOK TM by Look Nevers Company of France. It will be understood that the walking sole 10 of the present invention is also usable with other types of cleats such as cleats which provide a single transverse groove for engaging pedal structure and are used in combination with a toe cage for receiving the toe of the shoe.

The walking sole 10 includes a sole member 18 having a periphery which generally corresponds to the shape of the sole of the shoe. The sole member 18 includes a front portion 20 and a rear portion 22 which are connected together by a hinge 24, as will be described in more detail hereinafter. The front and rear portions of the sole member are suitably provided by a resiliently deformable material which wears sufficiently well as a shoe sole. The front portion 20 of the sole member 18 is provided with a recess or opening 26 which receives the cleat 14 when the walking sole 10 is converted into the walking configuration as is illustrated in FIG. 3. Sole member 18 thus has a thickness which is sufficient to prevent the cleat from extending out of the opening 26 in the front portion 20 of the sole member 18 when in the walking configuration. Crepe rubber having a thickness of about ½" has been found to be a particularly suitable material to provide the sole member 18.

The opening 26 has a suitable shape to receive the cleat 14 and provide a stable walking surface about the cleat 14 when the walking sole 10 is in the walking configuration. Preferably, the opening 26 has a generally triangular shape as shown in FIG. 2 which is capable of receiving several different types of cleats. It will of course be understood that the shape of the opening 26 can be varied to accommodate other types of cleats. If desired, the opening 26 can be provided with a covering to provide a continuous walking surface on the underside of the walking sole 10 while forming recess on the upper side of the walking sole to receive the cleat 14.

The hinge 24 is preferably provided by a strip of flexible material which is attached to the underside of the walking sole 10 and spans between the front portion 20 and the rear portion 22 from the sole member 18. In order to provide a smooth walking surface on the underside of the walking sole 10, the hinge 24 is preferably recessed into the underside of the sole member 18 as illustrated. The hinge 24 is suitably provided by a flexible strip of rubber or fabric secured to the front and rear portions 20 and 22 such as by gluing with a suitable glue, e.g., contact cement.

Referring to FIG. 2, the rear portion 22 of the sole member 18 is attached to the shoe 12. Preferably, the rear portion 22 is secured to the shoe sole 13 by means of hook and loop pile fasteners such as the fasteners sold under the trademark Velcro TM. In the preferred embodiment illustrated, a wide loop pile strip 28 is attached such as by gluing along a substantial part of the rear portion of the shoe sole 13. A hook pile strip 30 of corresponding length and width is attached such as by gluing to the rear portion 22 of the sole member 18. Hook and loop pile strips having a width of about 1½ inches and extending the length of the rear portion are suitable.

The front portion 20 of the sole member 18 is selectively secured in a walking position to provide the walking configuration of the walking sole 10 and in the riding position to provide the riding configuration. Preferably, hook and loop pile fasteners are employed for this purpose. Most preferably, a folded-over loop pile strip 32 such as a ¾ inch loop pile strip is attached at the front most portion of the front portion of the sole member 18. A hook pile strip 34 is attached at the toe and a similar hook pile strip 36 is attached at the heel of the bicyclist's shoe 12. Three-quarter inch hook pile strips having a short length, for example, 1 inch are suitable. As illustrated in FIG. 3, the folded-over loop pile strip 32 has sufficient length to extend upwardly around the toe of the shoe 12 and attach to the hook pile strip 34. In the riding position as shown in FIG. 1, the folded-over loop pile strip 32 extends upwardly around the heel to secure the front portion 20 in the riding position by attaching to the hook pile strip 36.

In use, the bicyclist attaches the walking sole by contacting the hook pile strip 30 on the walking sole 10 with the loop pile strip 28 on the shoe 12 as shown in FIG. 2 to secure the rear portion of the shoe. As shown in FIG. 3, the folded-over loop pile strip 32 is contacted with hook pile strip 34 to attach the front portion 20 in the walking position. The walking sole 10 thus is in the walking configuration and provides a generally smooth walking surface with the cleat being protected within the opening 26. To convert the walking sole 10 to the riding configuration, a bicyclist disengages the folded-over loop pile strip 32 from hook pile strip 34 and folds the front portion 20 rearwardly at the hinge 24 and secures the folded over loop strip to the hook pile strip 36. The bicyclist then can engage the cleat 14 with the structure for engaging the cleat on the pedal 16. In the riding configuration, the front portion 20 of the sole member 18 is clear of the cleat 14 and does not interfere with riding.

The walking sole 10 in accordance with the present invention provides a walking sole which can be used for riding without removal of the sole and thus does not require the rider to carry the sole separately. The walking sole 10 is quickly and easily converted from the walking configuration to the riding configuration. In addition, the entire walking sole can be removed entirely from the shoe as may be desired for racing. The preferred construction is particularly advantageous since the use of hook and loop pile fasteners eliminates the need to make any major modifications which could damage or affect the comfort and fit of the shoe. Furthermore, the most preferred construction minimizes the possibility of damage to the hook pile strips due to their location on the heel and toe of the shoe and on the upper side of the walking sole. While the loop pile strip 28 is on the underside of the shoe, loop pile strips are not easily damaged and limited walking and riding without use of the walking sole will not substantially affect the performance of the strip 28 for use with the walking sole 10.

The components for the walking sole 10 in accordance with the present invention are advantageously sold as a kit. Such a kit can include the sole member 18 including the hook pile strip 30 and the folded-over loop pile strip 32. A variety of sizes of sole members 18 can be provided such that each size corresponds to, for example, a size range of two or three shoe sizes. The kit would then also contain strips for attachment to the shoe including the loop pile strip 28, the hook pile strips 34 and 36 and suitable instructions. Commercially available contact cement may be used to secure the strips to the shoe.

Although a particularly preferred embodiment of the present invention has been shown and described in the foregoing detailed description, it will be apparent that numerous modifications and variations can be made without departing from the spirit and scope of the invention as set forth in the appended claims.

What is claimed is:

1. A walking sole for use with a bicyclists' shoe having a cleat attached to the shoe sole to engage corresponding structure on the pedal of the bicycle, said walking sole comprising:

a sole member having a front portion and a rear portion and a periphery which generally corresponds to the outer edge of the shoe, said front portion having an opening configured to receive the cleat of the shoe;

hinge means connecting said front and rear sole portions such that said front portion folds under said rear portion to move from a walking position in contact with the shoe sole with the cleat in the opening to a riding position in which said front protion underlies said rear portion;

first fastening means for attaching said rear portion of said sole member to said shoe; and second fastening means for selectively attaching said front portion to the shoe in said walking position whereby said walking sole provides a generally smooth walking surface and for attaching said front portion to the shoe in said riding position whereby said front portion is clear of said cleat.

2. The walking sole of claim 1 wherein said first fastening means comprises hook and loop pile fasteners attaching said rear portion of said sole member to said shoe sole.

3. The walking sole of claim 2 wherein said hook and pile fasteners comprise a loop pile strip attached to the shoe sole and a hook pile strip attached to the upper side of said rear portion.

4. The walking sole of claim 1 wherein said second fastening means comprises hook and loop pile fasteners selectively attaching said front portion to the shoe in said walking and riding positions.

5. The walking sole of claim 4 wherein said hook and loop pile fasteners comprise a hook pile strip adjacent the toe of the shoe and a hook pile strip adjacent the heel of the shoe, said fasteners further comprising a loop pile strip attached to said front portion which extends away from and has sufficient length to attach to the hook pile strip on the toe of the shoe to secure said front portion in said walking position and to extend to said hook pile strip on said heel to secure said front portion in said riding position.

6. The walking sole of claim 5 wherein said loop pile strip attached to said front portion is a foldedover loop pile strip.

7. The walking sole of claim 1 wherein said thickness of said front portion of said walking sole adjacent said recess exceeds the thickness of said cleat.

8. The walking sole of claim 1 wherein said front and rear portions are fabricated from a resiliently deformable material.

9. The walking sole of claim 8 wherein said hinge means comprises a flexible strip attached to the underside of the spanning between the front and rear portions of said sole member.

10. A walking sole for use with a bicyclist's shoe having a cleat attached to its bottom surface to engage corresponding structure on the pedal of the bicycle, said walking sole comprising:

a resiliently deformable sole member having a front portion and a rear portion and a periphery which generally corresponds to the outer edge of the shoe, said front portion having an opening configured to receive the cleat of the shoe;

a flexible strip connecting said front and rear portions and acting as a hinge which enables said front portion to fold under said rear portion to move from a walking position in contact with the shoe sole with the cleat in the opening to a riding position in which said front portion underlies said rear portion;

a loop pile strip attached to the underside of the shoe sole and a hook pile strip attached to said rear portion for attaching said rear portion to the shoe sole;

a hook pile strip on the toe of the shoe and a hook pile strip on the heel of the shoe;

a folded-over loop pile strip which extends away from the front of the front portion and has sufficient length to reach and attach to the hook pile strip on the toe to selectively secure the front portion in the walking position and having sufficient length to extend to the hook pile strip on said heel to secure the front portion in the riding position;

whereby said front portion being in said walking position provides a smooth walking surface and said front portion in said riding position is clear of the cleat.

11. A walking sole kit for use with a bicyclist's shoe having a cleat attached to the shoe sole to engage corresponding structure on the pedal of the bicycle, said kit comprising:

a sole member having a front portion and a rear portion and a periphery which generally corresponds to the shape of the shoe sole, said front portion having an opening configured to receive the cleat of the shoe, said sole member further comprising hinge means connecting said front and rear sole portions and enabling said front portion to fold from a walking position in which the sole provides a smooth walking surface to a riding position in which said sole underlies said rear portion, said sole member further comprising a hook pile strip on the upper side of said rear portion and a loop pile strip which is attached to and extends away from the front of the front portion;

a loop pile strip for attachment to the shoe sole at a position corresponding to the position of the hook pile strip on the rear portion; and hook pile strips for attachment to the heel and toe of the shoe.

* * * * *